US006907920B2

(12) United States Patent
Warburton et al.

(10) Patent No.: US 6,907,920 B2
(45) Date of Patent: Jun. 21, 2005

(54) HEAT EXCHANGER PANEL

(75) Inventors: Robert E. Warburton, Jupiter, FL (US); William J. Cuva, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 138 days.

(21) Appl. No.: 10/058,621

(22) Filed: Jan. 29, 2002

(65) Prior Publication Data

US 2003/0141043 A1 Jul. 31, 2003

(51) Int. Cl.[7] ..... F28F 3/12
(52) U.S. Cl. ..... 165/168; 165/80.4; 165/169
(58) Field of Search ..... 165/80.4, 168, 165/169, 53, 170, 171; 60/806, 267; 361/699, 700; 428/34.4, 34.5

(56) References Cited

U.S. PATENT DOCUMENTS

| | | | | | |
|---|---|---|---|---|---|
| 2,968,918 | A | * | 1/1961 | Denison, Jr. | 60/260 |
| 3,630,449 | A | * | 12/1971 | Butler | 239/127.1 |
| 3,692,637 | A | * | 9/1972 | Dederra et al. | 205/114 |
| 3,768,256 | A | * | 10/1973 | Butter et al. | 60/260 |
| 3,780,529 | A | * | 12/1973 | Johnson | 60/804 |
| 4,583,583 | A | * | 4/1986 | Wittel | 165/46 |
| 4,838,031 | A | * | 6/1989 | Cramer | 60/39.091 |
| 4,838,346 | A | * | 6/1989 | Camarda et al. | 165/104.14 |
| 5,150,570 | A | * | 9/1992 | Shekleton | 60/39.36 |
| 5,233,755 | A | * | 8/1993 | Vandendriessche | 29/890.01 |
| 5,333,445 | A | | 8/1994 | Coffinberry | |
| 5,423,498 | A | * | 6/1995 | Fluegel | 244/117 A |
| 5,720,339 | A | * | 2/1998 | Glass et al. | 165/104.26 |
| 5,899,077 | A | * | 5/1999 | Wright et al. | 62/3.7 |
| 6,042,315 | A | | 3/2000 | Miller et al. | |
| 6,045,310 | A | | 4/2000 | Miller et al. | |
| 6,182,442 | B1 | * | 2/2001 | Schmidt et al. | 60/267 |
| 6,202,405 | B1 | * | 3/2001 | Beyer et al. | 60/267 |
| 6,397,581 | B1 | * | 6/2002 | Vidal et al. | 60/267 |
| 6,397,941 | B1 | * | 6/2002 | McCullough | 165/185 |
| 6,783,824 | B2 | * | 8/2004 | Steffier | 428/34.4 |

FOREIGN PATENT DOCUMENTS

DE 4321393 A1 * 6/1993

* cited by examiner

*Primary Examiner*—Tho v Duong
(74) *Attorney, Agent, or Firm*—Bachman & LaPointe, P.C.

(57) ABSTRACT

The present invention relates to a heat exchanger panel which has broad utility in high temperature environments. The heat exchanger panel has a first panel, a second panel, and at least one fluid containment device positioned intermediate the first and second panels. At least one of the first panel and the second panel have at least one feature on an interior surface to accommodate the at least one fluid containment device. In a preferred embodiment, each of the first and second panels is formed from a high conductivity, high temperature composite material. Also, in a preferred embodiment, the first and second panels are joined together by one or more composite fasteners.

33 Claims, 7 Drawing Sheets

HEAT EXCHANGER PANEL

STATEMENT OF GOVERNMENT INTEREST

Government has rights in this invention, pursuant to Contract No. NAS3-00177 awarded by NASA.

BACKGROUND OF THE INVENTION

The present invention relates to a novel heat exchanger panel which has particular utility in high temperature environments, such as in air breathing and rocket propulsion systems.

One method for fabricating a high temperature capability composite heat exchanger comprised processing or densifying a composite material with high temperature capability and metallic coolant containment tubes integrally assembled into the composite. This method required the use of expensive and high density (heavy) metal tubes which could not be removed for inspection or replacement. As a result, these old heat exchangers were heavy, costly, difficult to inspect, and virtually impossible to maintain.

SUMMARY OF THE INVENTION

Accordingly, it is an object of the present invention to provide a heat exchanger panel which is less complex, lighter, and less expensive to manufacture.

It is also an object of the present invention to provide a heat exchanger panel as above which is high temperature capable.

It is a further object of the present invention to provide a heat exchanger panel as above which is easy to inspect and repair.

It is yet a further object of the present invention to provide a heat exchanger panel as above which has utility in air breathing and rocket propulsion systems.

The foregoing objects are attained by the heat exchanger panels of the present invention.

In accordance with the present invention, a high temperature capable heat exchanger panel is provided. The heat exchanger panel broadly comprises a first panel, a second panel, and at least one fluid containment device positioned intermediate the first and second panels. At least one of the first panel and the second panel have at least one feature on an interior surface to accommodate the at least one fluid containment device which is separable from and independent of the first and second panels.

In a preferred embodiment of the present invention, each of the first and second panels is formed from a high conductivity, high temperature composite material such as a high conductivity, high temperature carbon/carbon composite material and/or a high conductivity, high temperature carbon/silicon carbide composite material.

Also, in a preferred embodiment of the present invention, the first and second panels are joined together by one or more composite fasteners. The fasteners may also be used to join a heat exchange panel in accordance with the present invention to a substructure.

Other details of the heat exchanger panel of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
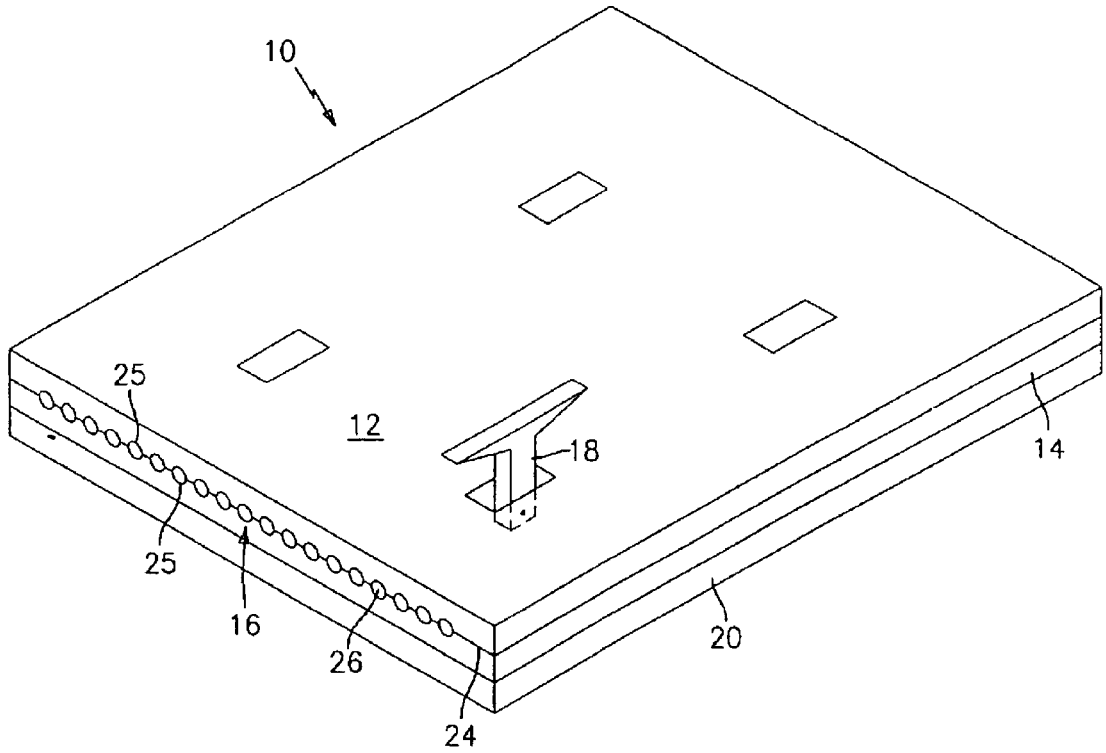
FIG. 1 is a perspective view of a heat exchanger panel in accordance with the present invention.
Figure 2:
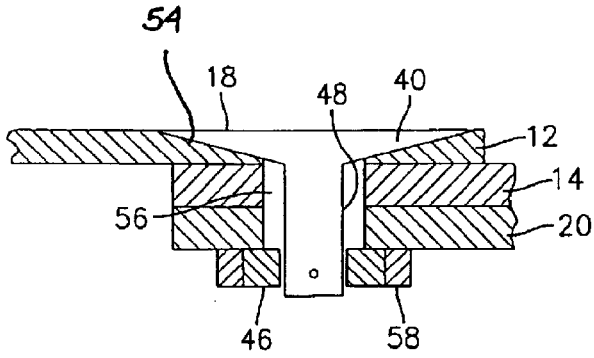
FIG. 2 is a sectional view of a portion of the heat exchanger panel of FIG. 1 showing a fastener for joining the panel to a substructure.

Referring now to the drawings, FIGS. 1 and 2 illustrate a heat exchanger panel 10 in accordance with the present invention. The heat exchanger panel 10 includes a first panel 12, a second panel 14, and a fluid containment device 16 positioned intermediate the first and second panels 12 and 14. The fluid containment device 16 may be formed from any suitable metallic and/or non-metallic materials known in the art, such as composite materials. In accordance with the present invention, the fluid containment device 16 is not fastened to either panel 12 or panel 14 in any manner. Rather, it is merely sandwiched between the panels 12 and 14.

The panel 10 further includes one or more fasteners 18 for joining the first and second panels 12 and 14 together and/or for joining the heat exchanger panel 10 to a substructure 20, such as a load carrying substructure. When the panels 12 and 14 are joined together in this manner, they hold the fluid containment device 16 in place.

In order to enable the heat exchanger panel 10 to be used in a high temperature environment, such as a wall panel for a scramjet engine or a rocket engine, each of the panels 12 and 14 is formed from a lightweight, high conductivity, high temperature capable composite material, preferably a non-metallic composite material. Suitable high conductivity, high temperature materials for the panels 12 and 14 include, but are not limited to, high conductivity, high temperature carbon/carbon and/or carbon/silicon carbide composite materials. Carbon/silicon carbide composite materials preferably are used only in situations where the temperature encountered by the panel(s) does not exceed 3000 degrees Fahrenheit. In accordance with the present invention, each of the panels 12 and 14 may be a simple monolithic sheet of material. Such sheets are advantageous in that they do not require expensive tooling and are not labor intensive to fabricate. Yet another advantage is that the aforementioned composite materials may be densified to be at least 75 to 80% dense using any number of common techniques known in the art and may be easily coated with an oxidation resistant material. Both densification and coating may be performed prior to installation of any fluid containment device 16.

In order to accommodate and position the fluid containment device 16, an interior surface 24 of each of the panels 12 and 14 is provided with a surface feature 25 which conforms to the exterior shape of the fluid containment device. For example, in the heat exchanger panel embodiment of FIG. 1, the fluid containment device 16 may comprise a plurality of parallel fluid passageways or tubes 26 connected to fluid inlet and outlet manifolds (not shown). In this embodiment, the surface feature 25 comprises a plurality of arched portions or grooves for receiving conforming the interior surface 24 to the exterior shape of the tubes 26.

While it is preferred to have appropriate surface features on each of the interior surfaces 24 of the panels 12 and 14, it should be noted that one could design a heat exchange panel so that the interior surface 24 of the panel 12 has a surface feature 25, while the interior surface 24 of the panel 14 is planar or flat.

While the tubes 26 have been shown as having circular cross-sections, it should be realized that they could have other cross-sectional shapes. When such other cross-sectional shapes are used, the surface feature(s) 25 are shaped to conform to the shape of the tubes 26.

Figure 4:
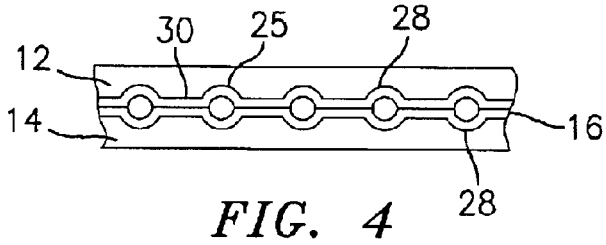
FIG. 4 is an end view of an alternative heat exchanger panel in accordance with the present invention.
Figure 5:
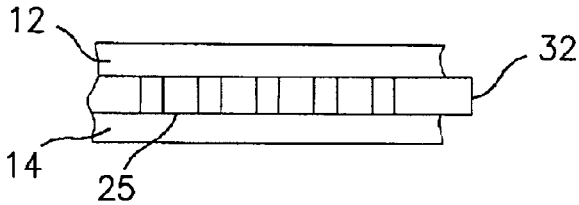
FIG. 5 is an end view of a heat exchanger panel embodiment with a machined metal assembly forming a coolant fluid containment device.

In the embodiment of FIG. 4, the fluid containment device 16 may comprise two metallic sheets 28 which are formed to create fluid passages and which are brazed, bonded, or welded at the contact points. As before, the fluid passages may be joined to fluid inlet and outlet manifolds (not shown). In this embodiment, the surface features 25 on the panels 12 and 14 comprise a plurality of arched portions separated by planar portions 30 to accommodate the metallic sheets 28.

In yet another embodiment of the present invention, the fluid containment device 16 may be a metallic heat exchanger 32 having thin planar face sheets to minimize weight. In this embodiment, the fluid passages in the metallic heat exchanger 32 may be joined to integrally formed fluid inlet and outlet manifolds (not shown). In this embodiment, the surface feature 25 is a planar interior surface feature on each of the panels 12 and 14 because there is no need to accommodate tubular cooling arrays.

The composite material panels 12 and 14 used in the heat exchanger panel 10 may be woven to minimize labor costs. The surface features 25 required to accommodate the fluid containment device 16 may be woven in to avoid machining and cutting fibers, if they can not be molded. If conductivity is an issue, a 2D lay-up could be used in order to cut down on the through thickness conduction.

Where high through the thickness conductivity is desired, a pitch fiber may be used in the composite materials forming the panels 12 and 14 and heat set after 3-D weaving to drive the conductivity as high as possible, while still allowing for weaving.

Figure 3:
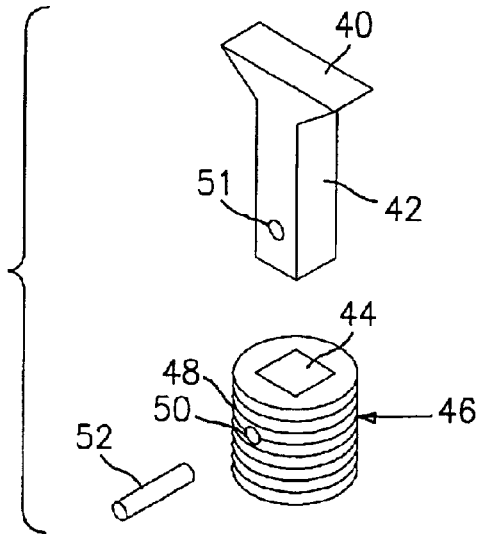
FIG. 3 is an exploded view of a fastener used with the heat exchanger panel of the present invention.

As previously mentioned, the panels 12 and 14 of the heat exchanger panel 10 are joined together by one or more fasteners 18. Each of the fasteners 18 is preferably formed from a high temperature capable composite material. Suitable composite fasteners which may be used are shown in U.S. Pat. Nos. 6,042,315 and 6,045,310, both to Miller et al., which are hereby incorporated by reference herein. As shown in FIG. 3, each of the fasteners 18 has an enlarged head portion 40 and a rectangularly or square shaped shaft 42. The shaft 40 is received by a rectangularly or square shaped orifice 44 in a metal sleeve 46. The metal sleeve 46 has an exterior thread 48 and a bore 50 for receiving a locking pin 52. The locking pin 52 is inserted through the bore 50 into a bore 51 in the shaft 42, thereby securing the sleeve 46 and the fastener 18 together.

Referring now to FIG. 2, the panel 12 has a countersunk bore 54 for receiving the head portion 40 of the fastener 18. The panels 12 and 14 and the substructure or back structure 20 having mating bores 56 for receiving the shaft 42 of the fastener 18. To secure each fastener 18 in place and thus secure the panels 12 and 14 and the substructure 20 together, a nut 58 is threaded onto the sleeve 46. The use of the composite fasteners 18 allows the panel 10 to be mechanically assembled and disassembled periodically for inspection and maintenance and to allow easy removal of the fluid containment device 16 or portions thereof.

The fluid containment devices 16 described herein may be used to transfer a coolant fluid through its passages. Alternatively, they may be used in some situations to heat or pre-warm a fluid, such as fuel, to be delivered to a portion of a propulsion system.

As can be seen from the foregoing description, the two piece heat exchanger panel of the present invention sandwiches the fluid containment device/manifold system and utilizes low cost composite materials and fabrication techniques. The material thickness of the panel 10 may be minimal, since it is for fluid/coolant containment only. The weight of the fluid containment device 16 is not a large contributor to the weight of the panel 10. Thin conductive foils or paste could be used in areas where voids exist to enhance thermal conduction. This, in addition to thermal expansion and flowpath pressure, should result in good thermal conductivity from the composite to the fluid/coolant. One advantage to the panel of the present invention is that the panels 12 and 14, when heated and/or pressurized, will conform to the coolant passage contour of the composite resulting in good thermal conduction.

Figure 6A:
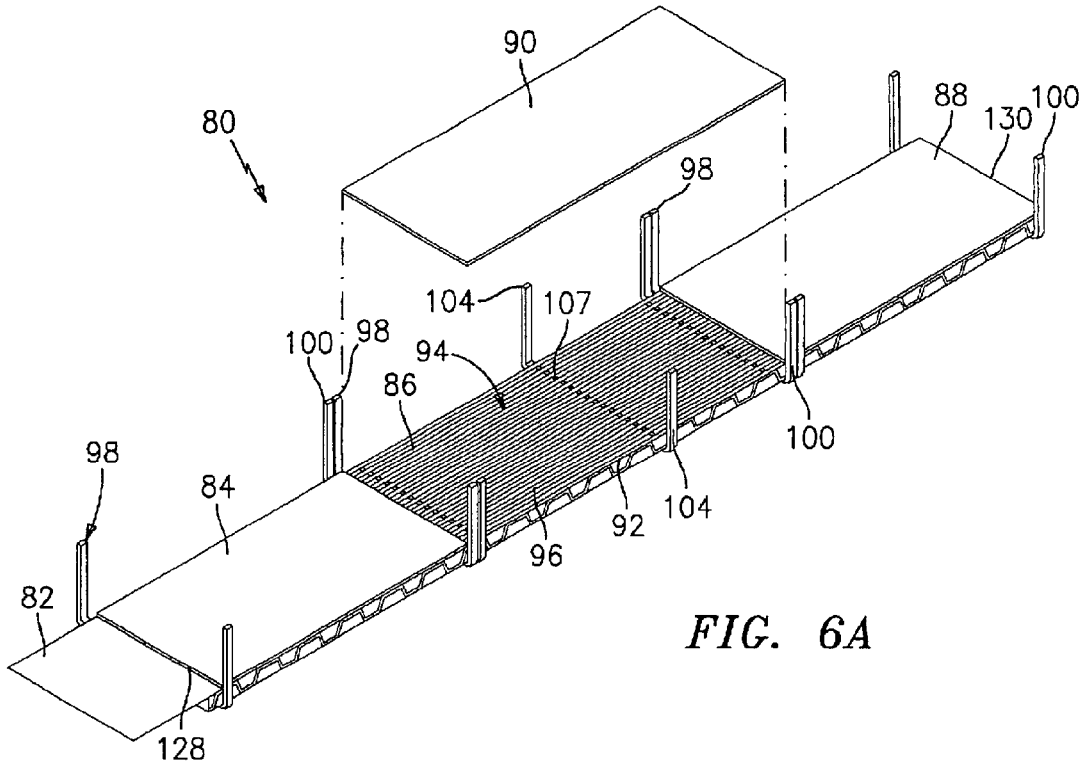
FIG. 6A is an exploded view of a wall of a propulsion engine having heat exchanger panels in accordance with the present invention.
Figure 6B:
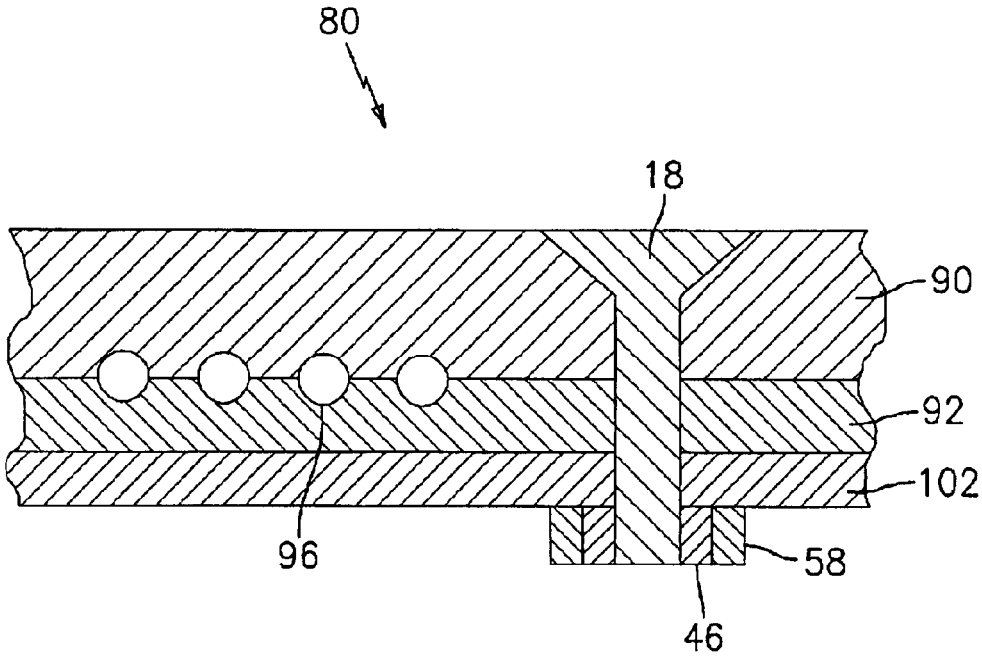
FIG. 6B is a sectional view of a portion of the wall of FIG. 6A.

The heat exchanger panel 10 of the present invention has utility in a wide range of air breathing propulsion systems such as jet turbine engines, ramjet engines and, in particular, a scramjet engine such as that shown in U.S. Pat. No. 5,333,445, which is incorporated by reference herein. A number of portions of such air breathing propulsion engines are subjected to extreme temperatures and require cooling. These portions include the cowl wall and the engine sidewalls of a scramjet engine amongst others. Also, the heat exchanger panel 10 may be used in rocket propulsion systems. FIGS. 6A and 6B illustrate one way in which a wall 80, such as a cowl wall, can be provided with a heat exchanger panel 10 in accordance with the present invention.

As can be seen from these figures, a wall 80, such as the cowl wall, may have a leading edge 82, an inlet section 84, a combustion panel section 86, and a nozzle section 88. The leading edge 82 may be formed from any suitable high temperature composite material known in the art, preferably a non-metallic composite material. Each of the sections 84, 86, and 88 may be formed from a heat exchanger panel in accordance with the present invention. For example, each of the sections 84, 86, and 88 may have a first or hot panel 90 formed from a high conductivity, high temperature capable composite material which forms the hot side of the wall, a second panel 92 formed from a composite material which forms a lower cold wall, and a coolant containment system 94 comprising a plurality of tubes or fluid passageways 96 which extend between a coolant inlet manifold (not shown) and a coolant outlet manifold (not shown). As can be seen from FIG. 6A, the tubes or fluid passageways 96 run parallel to a longitudinal axis of the wall 80. A first one of the manifolds may communicate with inlet tubes 98 for introducing a coolant into the tubes or fluid passageways 96. A second one of the manifolds may communicate with outlet tubes 100 through which heated coolant can be removed from the tubes or fluid passageways 96. The heated coolant may be passed through a heat exchanger (not shown) to be cooled and recycled.

The panels 90 and 92 may be formed as discussed above and may be provided with appropriate surface features for accommodating the tubes 96 of the coolant containment system 94. Each of the panels 90 and 92 may be formed from a composite material selected from a group consisting of a carbon/carbon composite material and a carbon/silicon carbide composite material. The panels 90 and 92 may be joined to each other and to a substructure or back structure 102 using the composite fasteners 18 in the manner discussed above. The substructure 102 may be formed from any suitable metallic or non-metallic material known in the art. Typically, the substructure 102 will be formed by a hollow metallic structure.

Figure 8:
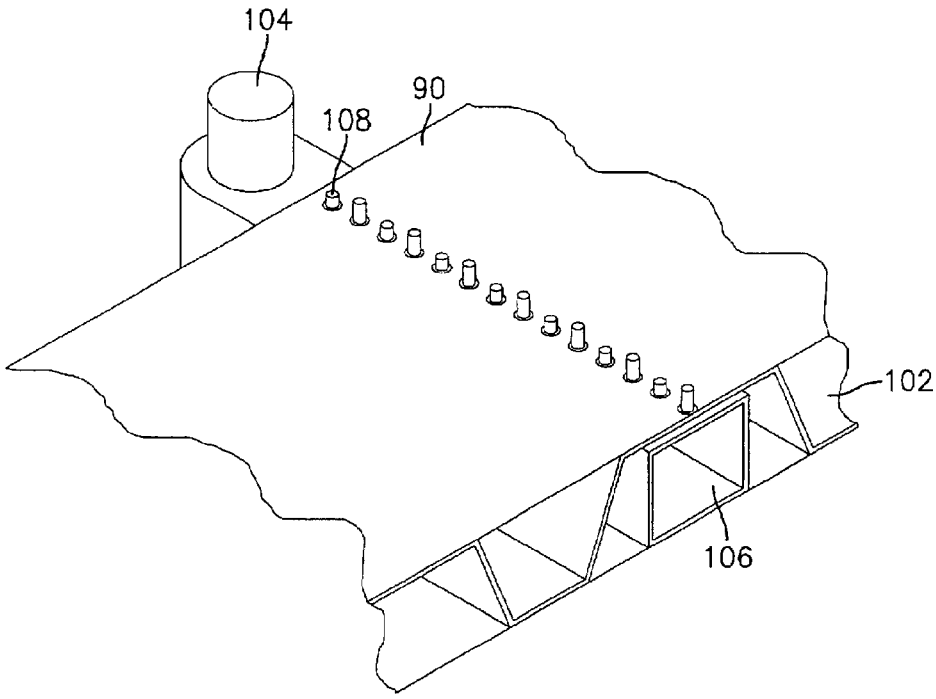
FIG. 8 is a perspective view of a portion of a combustion panel having an alternative fuel injection system.
Figure 7:
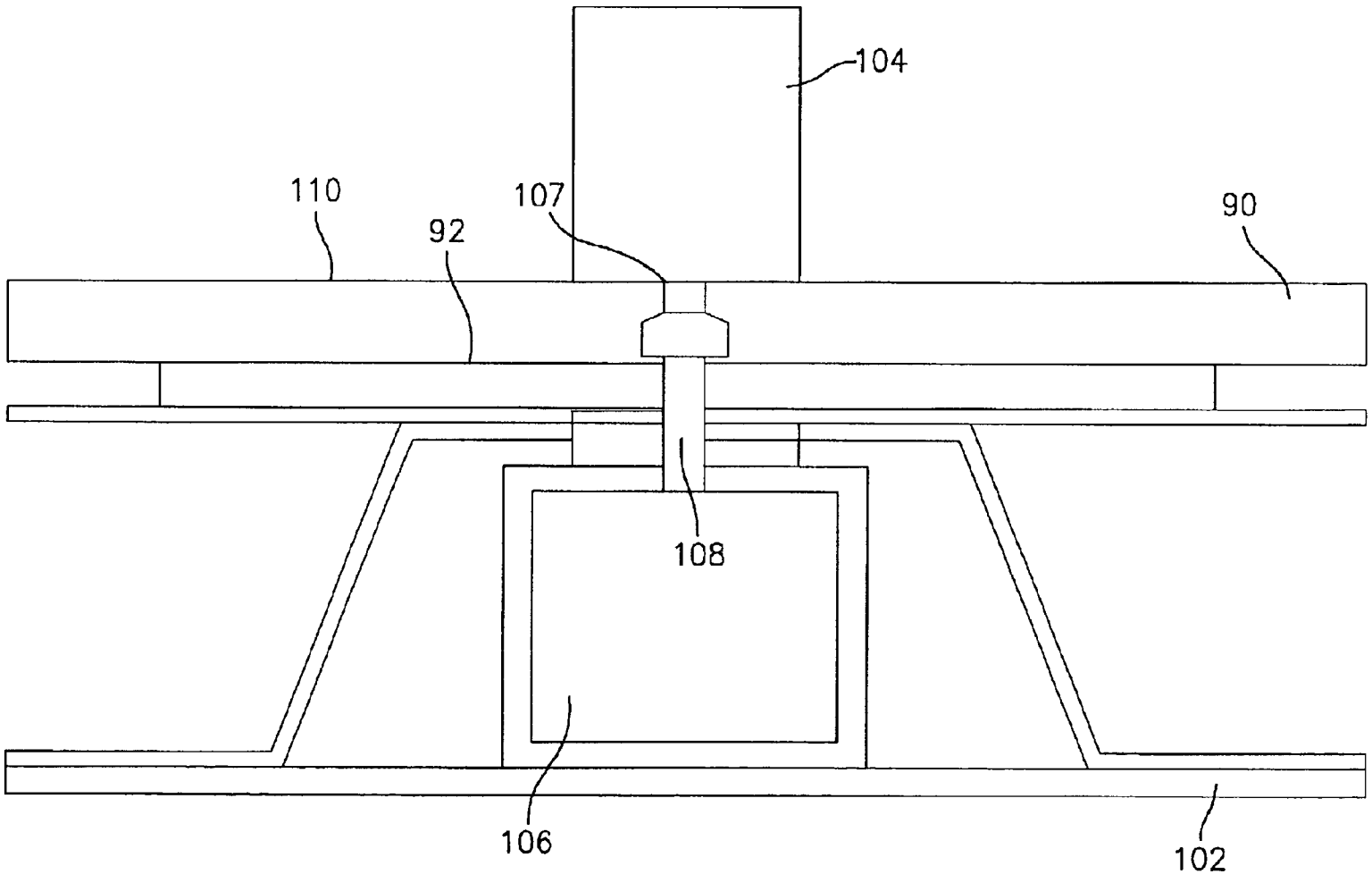
FIG. 7 is a sectional view of a portion of a combustion panel having a flush wall fuel injection system.

The combustion panel section 86 may also be used to distribute cooled fuel into a space bounded by the wall 80 of the air breathing propulsion system. To this end, the combustion panel section 86 may be provided with one or more fuel supply tubes 104 which are each connected to a manifold 106 which extend transverse to the longitudinal axis of the wall 80. As shown in FIGS. 7 and 8, each manifold 106 may be situated within the substructure 102 and may communicate with a plurality of injection nozzles 108 through which heated fuel is injected into the engine. As shown in FIG. 7, the injection nozzles 108 may terminate flush with the surface 110 or relatively close to the surface 110, i.e. less than 0.010 inches below the surface 110, of the hot panel 90 of the combustion panel section 86. Alternatively, as shown in FIG. 8, the injection nozzles 108 may extend through the hot panel 90 of the combustion panel section 86 and have their outlets above the surface 110. If desired, the substructure or back structure 102 may be slotted in the area of each injection nozzle 108 to allow for thermal differential growth between the cold panel 92 and the substructure or back structure 102. Further, each hot panel 90 has a plurality of openings 107 with each injection nozzle 108 having its outlet aligned with one of the openings 107.

Figures 10, 11:
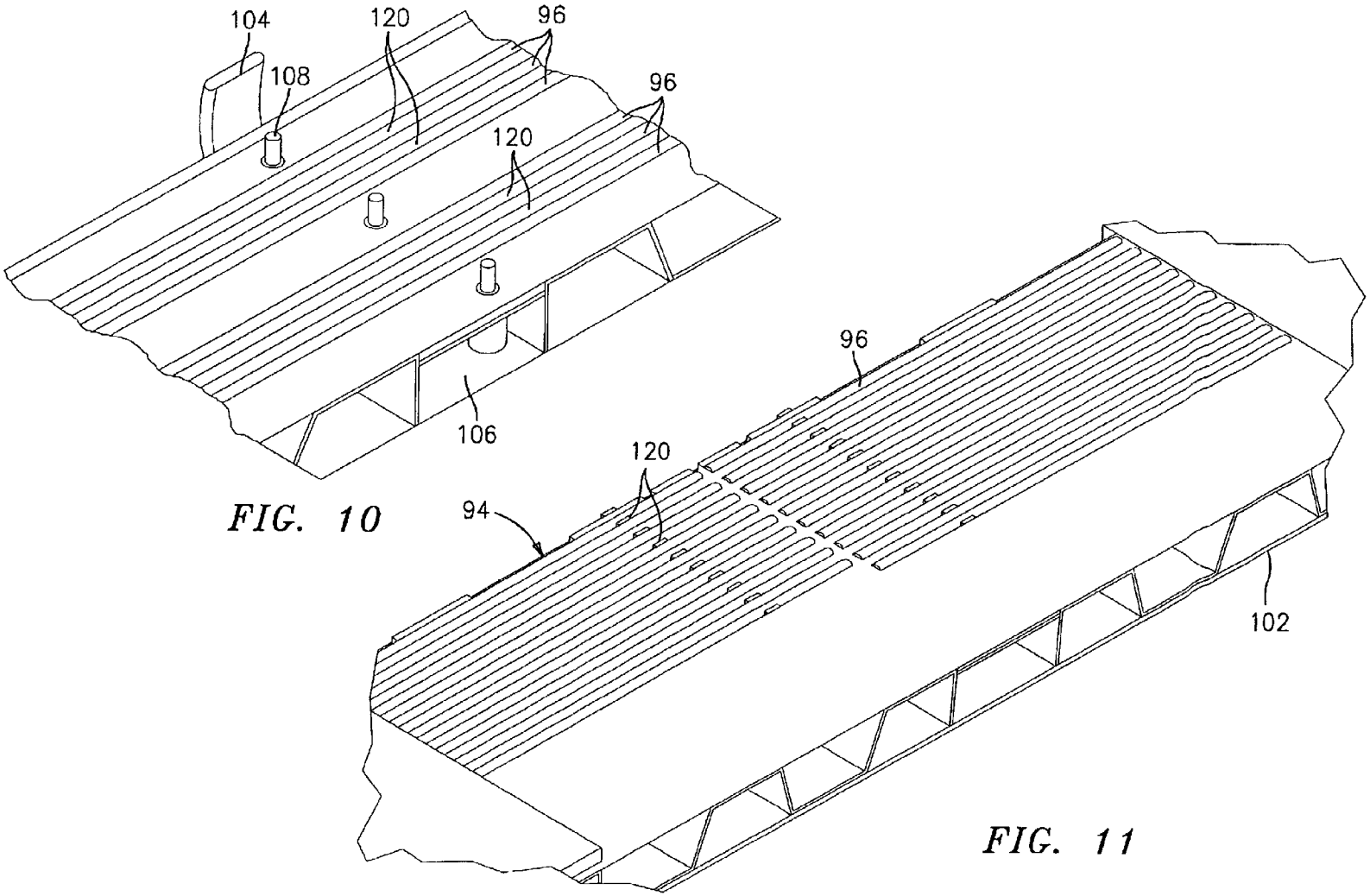
FIG. 10 is a perspective view of a portion of a panel having spacers for accommodating a fluid containment system.
FIG. 11 is a perspective view of a portion of the panel of FIG. 9 having spacers for accommodating a fluid containment system.

In some instances, it may be desirable to not have a continuous cold panel 92. In such situations, a discontinuous cold panel 92 may be utilized. As shown in FIGS. 10 and 11, in lieu of a continuous cold panel 92, local supports or spacers 120 may be used to maintain separation between the fluid passageways or tubes 96 in the fluid containment system 94. The spacers 120 are preferably joined to the substructure or back structure 102. If desired, however, the spacers 120 may be joined to the underside of the hot panel 90. Any suitable means known in the art may be used to join the spacers 120 to the substructure or back structure 102 or the panel 90. If desired, the spacers 120 may be integrally formed with the substructure 102. In this type of system, the hot panel 90 may be joined to the substructure 102 directly via the composite fasteners 18 in the manner previously mentioned herein.

Figure 9:
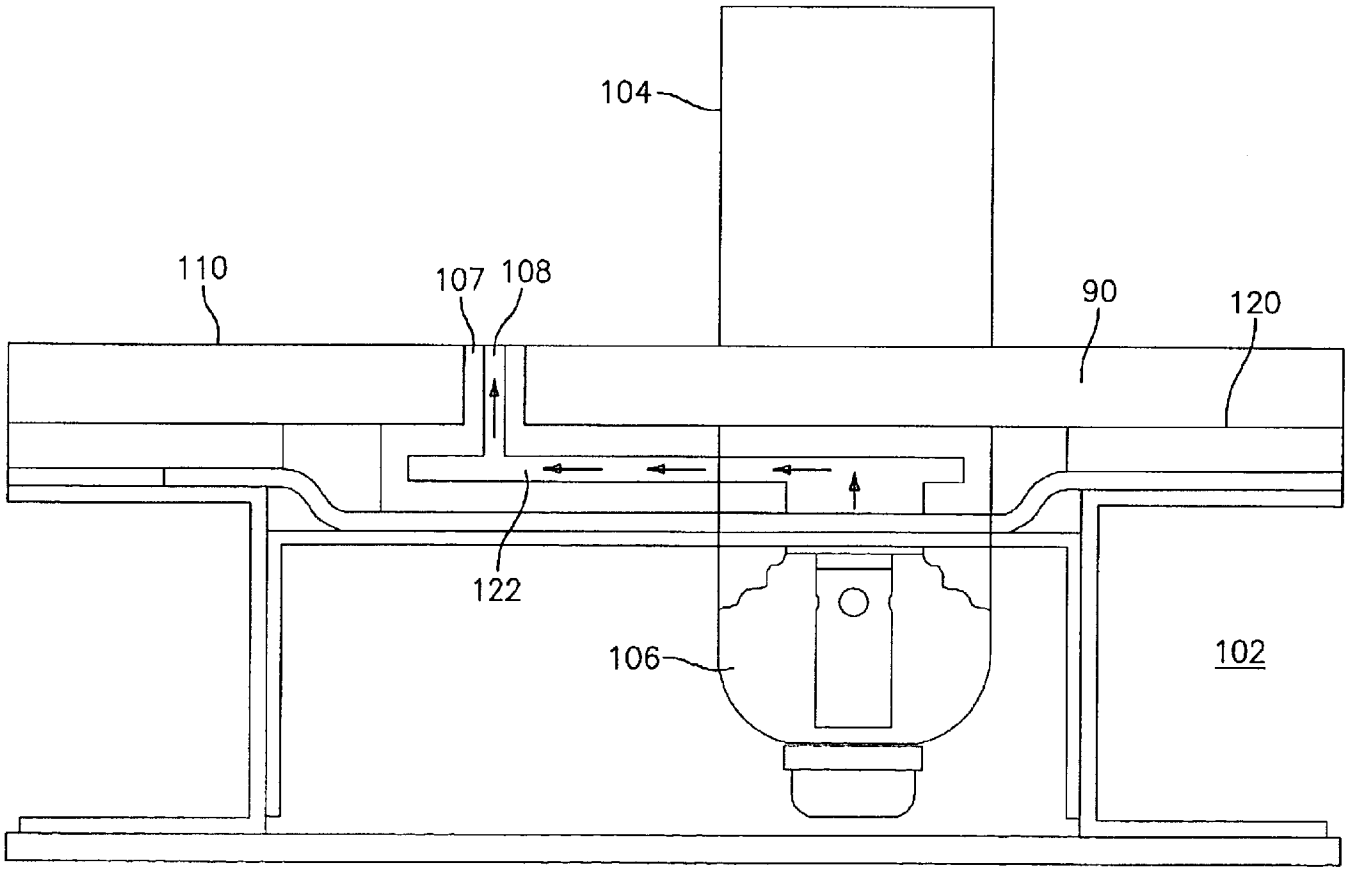
FIG. 9 is a sectional view of another embodiment of a combustion panel having a fuel injection system.

FIG. 9 illustrates an alternative embodiment of a flush wall fuel injector system. In this embodiment, fuel enters manifold 106 via fuel line 104 and traverses to the injector nozzles 108 via conduits 122 located intermediate the hot panel 90 and the substructure 102. If desired, the substructure 102 may be slotted to allow the injector nozzles 108 to move with the panel.

In the wall system of FIG. 6, the inlet, combustion panel, and nozzle sections 84, 86, and 88 have been shown as being separate heat exchanger panels. If desired, these sections could be formed from a single heat exchanger panel 10 which extends from a point 128 near the leading edge 82 to a trailing edge point 130. The single heat exchanger panel would have a single hot panel 90 and a single cold panel 92 which extends from the point 128 to the point 130. In such an embodiment, the fluid/coolant containment system 94 may extend from an inlet manifold adjacent one of the points 128 and 130 to an outlet manifold adjacent the other of the points 128 and 130. A fuel injection system such as those discussed above may be placed anywhere along the panel as required.

In yet another embodiment of the present invention, the wall 80 may be formed by a heat exchanger panel which has a cold panel 92 that extends from the point 128 to the point 130 and a hot panel 90 which is made up of a plurality of sections as shown in FIG. 6. Such an arrangement has the advantage that if a particular area of the heat exchanger panel 10 has to be inspected, only one of the hot panels 90 needs be removed.

It is apparent that there has been provided in accordance with the present invention a heat exchanger panel which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations which fall within the broad scope of the appended claims.

What is claimed is:

1. A heat exchanger panel comprising:

a first panel;

a second panel, said second panel being separate from said first panel;

each of said first and second panels being formed from a high temperature composite material;

said first panel being formed from one of a carbon/carbon composite material and a carbon/silicon carbide composite material and said second panel being formed from one of a carbon/carbon composite material and a carbon/silicon carbide composite material; and a fluid containment device separate from, sandwiched between, and held in place by said first and second panels, said fluid containment device not being fastened to either of said first and second panels.

2. A heat exchanger panel according to claim 1, further comprising at least one composite fastener for joining said first panel to said second panel.

3. A heat exchanger panel comprising:

a first panel;

a second panel, said second panel being separate from said first panel;

each of said first and second panels being formed from a high temperature composite material;

a fluid containment device separate from, sandwiched between, and held in place by said first and second panels, said fluid containment device not being fastened to either of said first and second panels;

at least one composite fastener for joining said first panel to said second panel; and each said composite fastener comprising a shaft formed from a composite material, said shaft having a first bore, a metal sleeve having an orifice for receiving a portion of said shaft and a second bore extending perpendicular to said orifice, and a locking pin which is inserted into said second bore and said first bore for securing said shaft to said metal sleeve.

4. A heat exchanger panel according to claim 3, further comprising said metal sleeve having an exterior thread and a threaded nut for engaging said exterior thread on said metal sleeve.

5. A heat exchanger panel according to claim 2, wherein said at least one composite fastener further attaches said heat exchange panel to a substructure.

6. A heat exchanger panel according to claim 1, further comprising each of said first and second panels having a surface feature on an interior surface to accommodate said fluid containment device.

7. A heat exchanger panel according to claim 6, wherein said fluid containment device comprises a plurality of tubes and said surface feature on each interior surface comprises a plurality of arched portions.

8. A heat exchanger panel according to claim 6, wherein said fluid containment device comprises two joined metallic sheets formed to create fluid passages and said surface feature on each interior surface comprises a plurality of arched portions separated by planar portions.

9. A heat exchanger panel according to claim 6, wherein said fluid containment device comprises a metallic heat exchanger with planar face sheets and said surface feature on each interior surface comprises a planar surface feature.

10. A wall system for use in a propulsion system, said wall system comprising:

at least one heat exchanger panel forming part of a wall of said propulsion system;

said at least one heat exchanger panel having an outer panel and an inner panel;

each of said outer and inner panels being formed from a high temperature composite material;

at least one first bore in said inner panel being aligned with at least one second bore in said outer panel;

at least one fastener extending through said at least one first bore and said at least one second bore; and a coolant containment device separate from, sandwiched between, and held in place by said outer and inner panels.

11. A wall system according to claim 10, further comprising a substructure and said at least one fastener securing said outer and inner panels to said substructure.

12. A wall system according to claim 11, wherein each said fastener comprises a composite fastener.

13. A wall system for use in a propulsion system, said wall system comprising:

at least one heat exchanger panel;

said at least one heat exchanger panel having an outer panel and an inner panel;

each of said outer and inner panels being formed from a high temperature composite material;

a coolant containment device separate from, sandwiched between, and held in place by said outer and inner panels, said coolant containment device not being fastened to either of said first and second panels a substructure and at least one fastener for securing said outer and inner panels to said substructure; and said at least one fastener having a shaft formed from a non-metallic material and a first bore in said shaft, a metallic sleeve having an orifice for receiving an end portion of said shaft and having a second bore at an angle relative to said orifice, and a locking pin for joining said shaft to said metallic sleeve, said locking pin being inserted into said first and second bores.

14. A wall system according to claim 13, wherein said inner panel and said substructure each have a bore for receiving a portion of said shaft.

15. A wall system according to claim 10, further comprising a plurality of heat exchanger panels and said heat exchanger panels being aligned along a longitudinal axis of said wall system.

16. A wall system according to claim 10, further comprising a leading edge formed from a composite material.

17. A wall system according to claim 11, further comprising means for injecting fuel into a space bounded by said wall system.

18. A wall system according to claim 17, wherein said fuel injecting means comprises a fuel inlet conduit, a manifold connected to said fuel inlet conduit, and a plurality of injection nozzles connected to said manifold.

19. A wall system according to claim 18, wherein said outer panel has an outer surface with a plurality of openings and each of said injection nozzles extends through said openings and above said outer surface.

20. A wall system according to claim 18, wherein said outer panel has an outer surface and a plurality of openings and each of said injection nozzles has an outlet flush with said outer surface and aligned with one of said openings.

21. A wall system for use in a propulsion system, said wall system comprising:

at least one heat exchanger panel;

said at least one heat exchanger panel having an outer panel and an inner panel;

each of said outer and inner panels being formed from a high temperature composite material;

a coolant containment device sandwiched between said outer and inner panels;

a substructure and at least one fastener for securing said outer and inner panels to said substructure;

means for injecting fuel into a space bounded by said wall system;

said fuel injecting means comprising a fuel inlet conduit, a manifold connected to said fuel inlet conduit, and a plurality of injection nozzles connected to said manifold;

said outer panel having an outer surface and a plurality of openings; and each of said injection nozzles extending to a point just below said outer surface and being aligned with one of said openings.

22. A wall system according to claim 10, further comprising said outer and inner panels each extending from a point near a leading edge of said wall system to a point near a trailing edge of said wall system.

23. A wall system according to claim 22, wherein said coolant containment device comprises a plurality of tubular passageways extending parallel to a longitudinal axis of said wall system.

24. A wall system for use in a propulsion system, said wall system comprising:

at least one heat exchanger panel;

said at least one heat exchanger panel having an outer panel and an inner panel;

each of said outer and inner panels being formed from a high temperature composite material;

a coolant containment device separate from, sandwiched between, and held in place by said outer and inner panels, said coolant containment device not being fastened to either of said first and second panels said inner panel extending from a point near a leading edge of said wall system to a point near a trailing edge of said wall system; and said outer panel comprising a plurality of axially aligned panels.

25. A wall system according to claim 10, wherein said inner panel is a discontinuous panel.

26. A wall system according to claim 10, wherein said inner panel is formed from a plurality of spacers and said coolant containment device comprises a plurality of tubular passages separated by said spacers.

27. A wall system according to claim 10, wherein said propulsion system comprises a scramjet engine.

28. A wall system according to claim 10, wherein said propulsion system comprises a rocket engine.

29. A wall system for use in an air breathing propulsion system comprising:

at least one heat exchanger and a substructure forming a portion of a wall of said wall system;

said at least one heat exchanger having an outer panel formed from a composite material, an inner panel formed from a composite material, and a coolant containment device bounded by said outer and inner panels;

said coolant containment device being separate from said outer and inner panels and being held in place by said outer and inner panels, said fluid containment device not being fastened to either of said first and second panels and means for fastening said outer panel to said substructure.

30. A wall system according to claim 29, wherein said coolant containment device comprises a plurality of tubular passageways and said heat exchanger further comprises a plurality of spacers between said tubular passageways.

31. A wall system according to claim 29, further comprising means for injecting fuel into a space bounded by said wall system.

32. A wall system according to claim 29, wherein said composite material is selected from the group consisting of a carbon/carbon composite material and a carbon/silicon carbide composite material.

33. A wall system according to claim 29, wherein said fastening means comprises a composite fastener which connects the outer panel to the substructure.

* * * * *